US006378510B1

(12) United States Patent
Green et al.

(10) Patent No.: US 6,378,510 B1
(45) Date of Patent: Apr. 30, 2002

(54) EXHAUST GAS RECIRCULATION SYSTEM FOR AN INTERNAL COMBUSTION ENGINE HAVING AN INTEGRATED VACUUM REGULATOR AND DELTA PRESSURE SENSOR

(75) Inventors: John C. Green, Sterling Heights; Pete Brykailo; Richard J. Vaughan, both of Auburn Hills, all of MI (US); Daniel P. O'Brien, Dixon, IL (US); Thomas A. Horn, Eastpointe; Bennett J. Arndt, Canton, both of MI (US)

(73) Assignee: BorgWarner Inc., Troy, MI (US)

( * ) Notice: Subject to any disclaimer, the term of this patent is extended or adjusted under 35 U.S.C. 154(b) by 0 days.

(21) Appl. No.: 09/608,767

(22) Filed: Jun. 30, 2000

(51) Int. Cl.[7] ..... F02M 25/07
(52) U.S. Cl. ..... 123/568.27; 123/568.29
(58) Field of Search ..... 123/568.11, 568.26–568.29; 137/907; 251/129.09, 129.07, 129.15, 129.16

(56) References Cited

U.S. PATENT DOCUMENTS

| | | | | |
|---|---|---|---|---|
| 4,378,777 A | | 4/1983 | Iida et al. | 123/571 |
| 4,445,489 A | | 5/1984 | Kobayashi et al. | 123/571 |
| 4,455,987 A | | 6/1984 | Suedbeck et al. | 123/569 |
| 4,534,375 A | | 8/1985 | Fox | 137/82 |
| 4,541,398 A | | 9/1985 | Kishi | 123/571 |
| 4,566,423 A | | 1/1986 | Kenny et al. | 123/571 |
| 4,598,729 A | | 7/1986 | Naito et al. | 137/116.5 |
| 4,708,316 A | | 11/1987 | Cook | 251/39 |
| 4,919,168 A | | 4/1990 | Wagner | 137/627.5 |
| 4,947,887 A | | 8/1990 | Fox | 137/82 |
| 5,337,790 A | | 8/1994 | Heritier-Best et al. | 251/129.21 |
| 5,537,977 A | | 7/1996 | Hartman et al. | 123/422 |
| 5,613,479 A | | 3/1997 | Gates et al. | 123/568 |
| 6,116,224 A | * | 9/2000 | Cook et al. | 123/568.27 |

* cited by examiner

*Primary Examiner*—Henry C. Yuen
*Assistant Examiner*—Arnold Castro
(74) *Attorney, Agent, or Firm*—Bliss McGlynn & Nolan, P.C.; Greg Dziegielewski

(57) ABSTRACT

An exhaust gas recirculation system for an internal combustion engine including a valve body having an exhaust port adapted for fluid communication with a source of exhaust gas, an intake port adapted for fluid communication with the intake manifold of an internal combustion engine, and a valve member movably supported within the body between open and closed positions thereby controlling the flow of exhaust gas from the exhaust port to the intake port. A diaphragm housing is operatively mounted to the valve body and supported thereby. The diaphragm housing defines a vacuum cavity in fluid communication with a source of negative pressure and an atmosphere cavity in fluid communication with a source of second pressure. A diaphragm member is disposed between the vacuum and atmosphere cavities and is operatively connected to the valve member. The diaphragm member is movable in one direction in response to negative pressure induced in the vacuum cavity and in the opposite direction in response to a biasing force to move the valve member between its open and closed position. An integrated vacuum regulator is mounted to the system and supported thereby. The vacuum regulator is operable to control the movement of the valve member between its open and closed positions by controlling the negative pressure induced in the vacuum cavity. The system also includes an integrated pressure sensor which senses the difference between the pressure in the vacuum cavity and the pressure at the intake port.

17 Claims, 4 Drawing Sheets

EXHAUST GAS RECIRCULATION SYSTEM FOR AN INTERNAL COMBUSTION ENGINE HAVING AN INTEGRATED VACUUM REGULATOR AND DELTA PRESSURE SENSOR

BACKGROUND OF THE INVENTION

1. Field of the Invention

The present invention relates, generally, to exhaust gas recirculation systems for internal combustion engines and, more specifically, to an improved exhaust gas recirculation system having an integrated vacuum regulator and delta pressure sensor.

2. Description of the Related Art

Exhaust gas recirculation (EGR) valves are employed to control the recirculation of a portion of the exhaust gas generated from an internal combustion engine flowing through the exhaust manifold back into the combustion chamber via the intake manifold. Recirculation of exhaust gases to the air/fuel mixture at the intake of the internal combustion engine is conducive to the reduction of the concentration of noxious nitrogen oxides in the exhaust gases which are discharged from the engine. Accordingly, and for this reason, exhaust gas recirculation is effected typically on gasoline engines when the engine is operating under part-throttle or substantial-throttle conditions. More specifically, during idling conditions, negligible amounts of nitrogen oxides are produced in the combustion chambers of the engine and, therefore, there is little or no need of recirculating exhaust gases to the air/fuel mixture. On the other hand, under part-throttle or substantial-throttle conditions, the throttle valve which controls intake air to the internal combustion engine is held in a more open position so that sufficient air may be add mixed to the fuel. At the same time, and during these operating conditions, it is common to recirculate exhaust gases into the air/fuel mixture and thereby reduce the noxious emissions of the internal combustion engine.

Diesel engines typically utilize EGR during no load (idle) through medium load. In virtually all cases, gasoline and diesel, EGR is shut off as full-load conditions are approached.

The operation of the EGR valve and thus the amount of exhaust gas recirculated is often controlled by an electrically actuated vacuum regulator (EVR) as well as a differential pressure sensor, also known as a delta pressure sensor. In turn, signals to and from these components are controlled by an engine control module (ECM). The effective control and simultaneous coordination of the various EGR components presents some difficult challenges. More specifically, it is important to precisely actuate the EGR valve so that $NO_x$ emissions may be optimally minimized. The more components employed to effectively implement exhaust gas recirculation the longer is the system response time and the more difficult and costly it is to control the process. In the related art, the EGR valve, EVR and delta pressure sensor are typically separate components mounted at various places on the engine and interconnected via flexible or hard conduits referred to as "on-board plumbing." In systems presently employed in the related art, each component often requires its own mounting strategy and associated fasteners. The on-board plumbing must be routed so as not to clutter the engine. This object is not always met and EGR systems presently used in the field today can be difficult and expensive to service. Further, and because of the ever shrinking space available for the vehicle power plant, the effective use of space through efficient component packaging is a parameter which designers must constantly seek to improve.

Thus, there is a need in the art for exhaust gas recirculation systems which reduce the number of components needed to effectively recirculate exhaust gas to the air/fuel mixture. Further, there is a need for such a system that reduces the complicated on-board plumbing of the type required for vacuum actuated EGR systems. There is also a need in the art for an exhaust gas recirculation system that is easy and inexpensive to service in the field. Finally, there is a need in the art for an exhaust gas recirculation system which has improved response time and accurate repeatability and which is smaller than present systems employed in the related art.

SUMMARY OF THE INVENTION

The deficiencies in the related art are overcome by an exhaust gas recirculation system for an internal combustion engine of the present invention. The exhaust gas recirculation system includes a valve body having an exhaust port adapted for fluid communication with a source of exhaust gas, an intake port adapted for fluid communication with the intake manifold of an internal combustion engine, and a valve member movably supported within the body between open and closed positions thereby controlling the flow of exhaust gas from the exhaust port to the intake port. The system further includes a diaphragm housing which is operatively mounted to the valve body and supported thereby. The diaphragm housing defines a vacuum cavity in fluid communication with a source of negative pressure and an atmosphere cavity in fluid communication with a source of second pressure. A diaphragm member is disposed between the vacuum and atmosphere cavities and is operatively connected to the valve member. The diaphragm member is movable in one direction in response to negative pressure induced in the vacuum cavity and in the opposite direction in response to a biasing force to move the valve member between its open and closed position. The exhaust gas recirculation system of the present invention further includes an integrated vacuum regulator. The vacuum regulator is operable to control the movement of the valve member between its open and closed positions by controlling the negative pressure induced in the vacuum cavity. Furthermore, the EGR system of the present invention includes an integrated pressure sensor which senses the difference between the pressure in the vacuum cavity and the pressure at the intake port.

The exhaust gas recirculation system of the present invention results in elimination of a number of components found in conventional EGR systems. For example, there is no need for space or hardware to mount a separate vacuum regulator, or separate pressure sensor employed to sense the difference in pressure between the diaphragm and the intake manifold as well as no need for the associated on-board plumbing typically employed in connection with vacuum actuated EGR systems in the related art. Furthermore, the exhaust gas recirculation system of the present invention is more responsive when compared to the dispersed components that make up comparable systems known in the related art. In addition, the exhaust gas recirculation system of the present invention is relatively small and compact and therefore has improved "packaging" characteristics allowing engine designers greater freedom when positioning the EGR system of the present invention relative to other related engine components.

Other objects, features and advantages of the present invention will be readily appreciated as the same becomes better understood after reading the subsequent description taken in connection with the accompanying drawings.

DETAILED DESCRIPTION OF THE PREFERRED EMBODIMENT(S)

Figure 1:
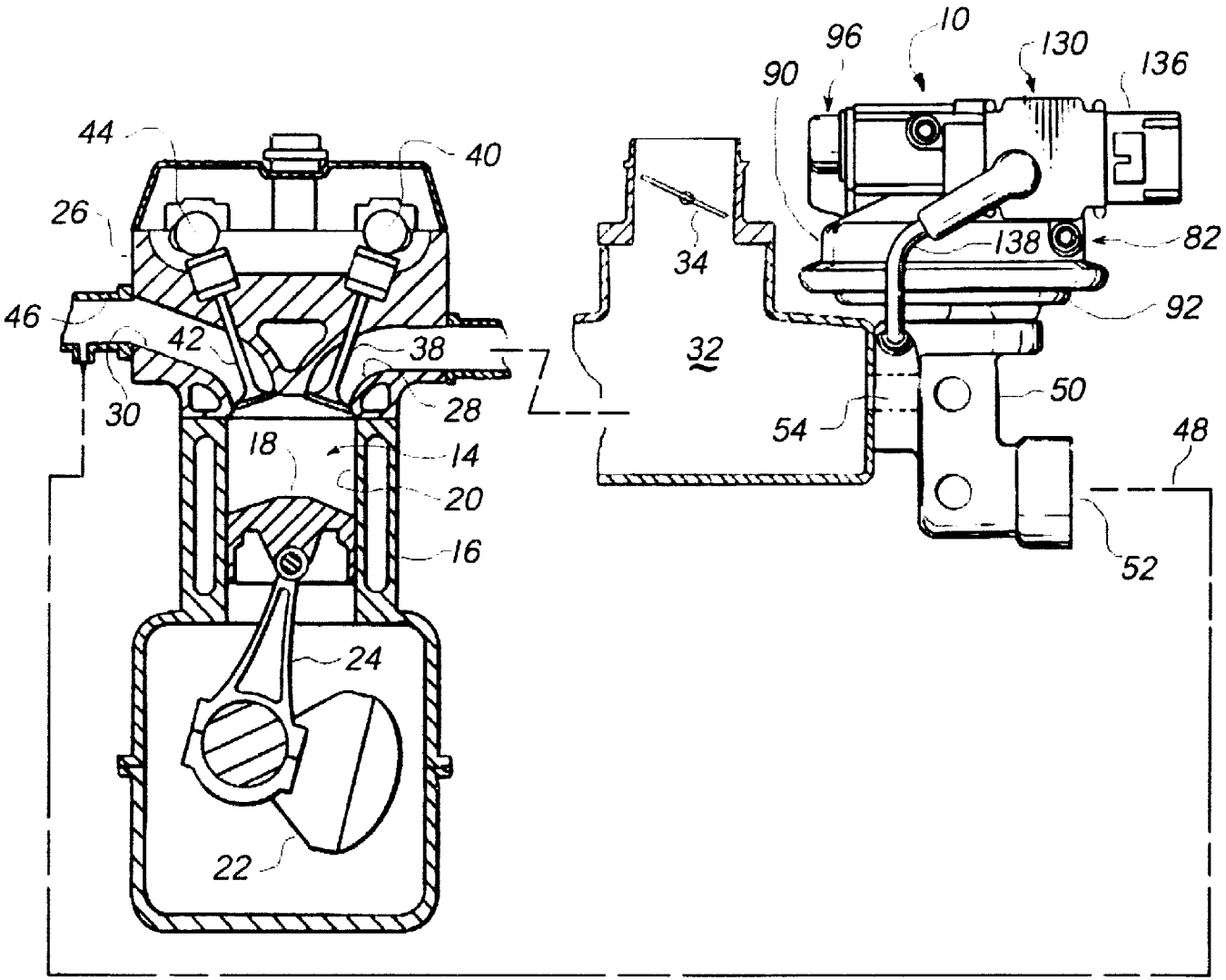
FIG. 1 is a schematic view of an internal combustion engine having the improved exhaust gas recirculation system of the present invention.

One embodiment of an exhaust gas recirculation system of the present invention is generally indicated at 10 in FIG. 1 and is shown in conjunction with a schematically illustrated internal combustion engine generally shown at 12. The internal combustion engine may include one or more combustion chambers arranged in any convenient manner such as in line or in a V-shaped configuration. Thus, the exhaust gas recirculation system 10 may be employed in conjunction with an internal combustion engine having a straight 4, straight 6, V-6, V-8, V-10 cylinder arrangements or the like. Furthermore, those having ordinary skill in the art will appreciate that the number and particular arrangement of the combustion chambers of the internal combustion engine form no part of the present invention. Thus, the internal combustion engine 12 is shown in FIG. 1 having one representative combustion chamber, generally indicated at 14, formed in an engine block 16. A piston 18 is supported for reciprocal motion within a cylinder 20. Together, the piston 18 and cylinder 20 define the combustion chamber 14. Reciprocal motion of the piston 18 in response to a combustion cycle in the cylinder 20 imparts rotary motion to a crankshaft 22 via the connecting rod 24 as is commonly known in the art.

A head 26 is mounted to the engine block 16 and includes at least one intake port 28 and at least one exhaust port 30. The intake port 28 is in fluid communication with an intake manifold, schematically represented at 32. Combustion air is drawn into the manifold 32 past a throttle 34 mounted in a throttle body 36 where it is mixed with partially atomized fuel vapor. The throttle 34 moves to adjust the opening of the throttle body 36 to adjust the amount of air flowing into the intake manifold 32 in response to certain predetermined parameters such as engine load, vehicle acceleration, etc. to regulate the air/fuel mixture to an optimum ratio.

In turn, the flow of the combustible air/fuel mixture into the cylinder 20 via the intake port 28 of the head 26 is controlled by one or more intake valves 38. The intake valves 38 may be supported in the head 26 for reciprocating motion under the influence of a camshaft 40 to open and close fluid communication between the intake port 28 and the cylinder 20, as is commonly known in the art.

Similarly, an exhaust valve 42 may be supported in the head 26 for reciprocating motion under the influence of a cam shaft 44 to open and close fluid communication between the cylinder 20 and the exhaust port 30. When the exhaust valve 42 is open, the products of combustion, including exhaust gases having partially combusted pollutants such as $NO_x$, are communicated to an exhaust manifold 46 through the exhaust port 30 formed in the head 26.

Where it is desired that the amount of pollutants should be reduced, a portion of the exhaust gas may be drawn off from the exhaust manifold 46 or any other suitable location on the engine and communicated to the exhaust gas recirculation system 10. Fluid communication of exhaust gases from its source (the combustion cylinder 20) to the exhaust gas recirculation system 10 is schematically represented by the dotted line 48. Thus, those having ordinary skill in the art will appreciate that any suitable means for achieving this type of fluid communication may be employed without departing from the scope of the invention.

Figure 3:
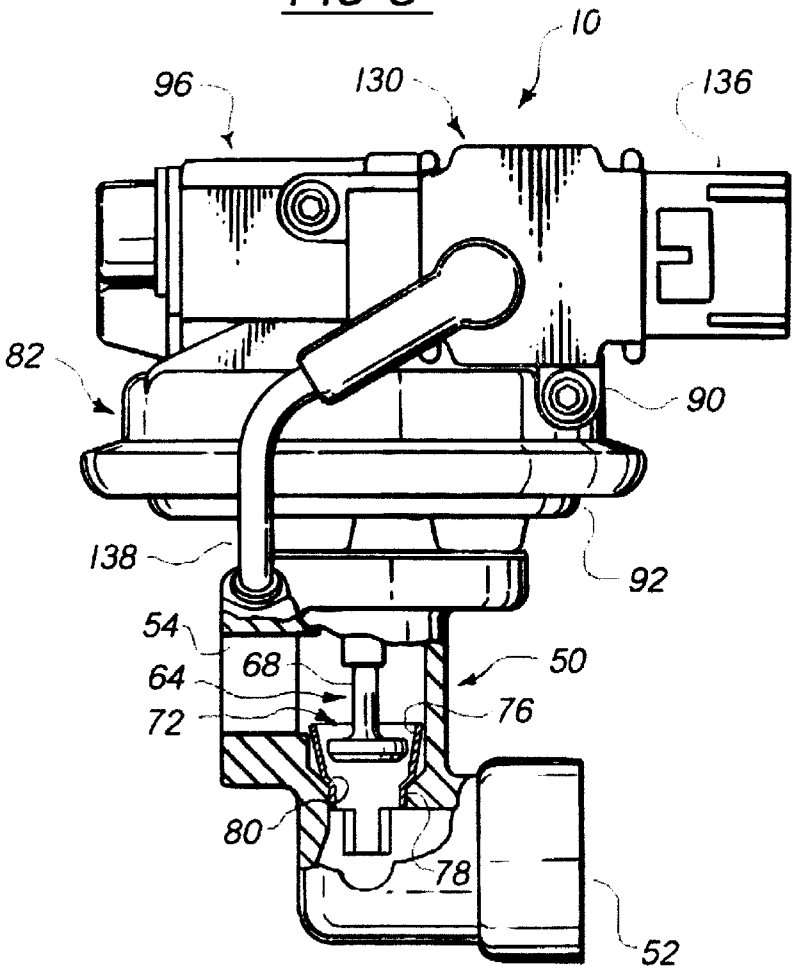
FIG. 3 is a partial cross-sectional side view of the exhaust valve recirculation system of the present invention.
Figure 2:
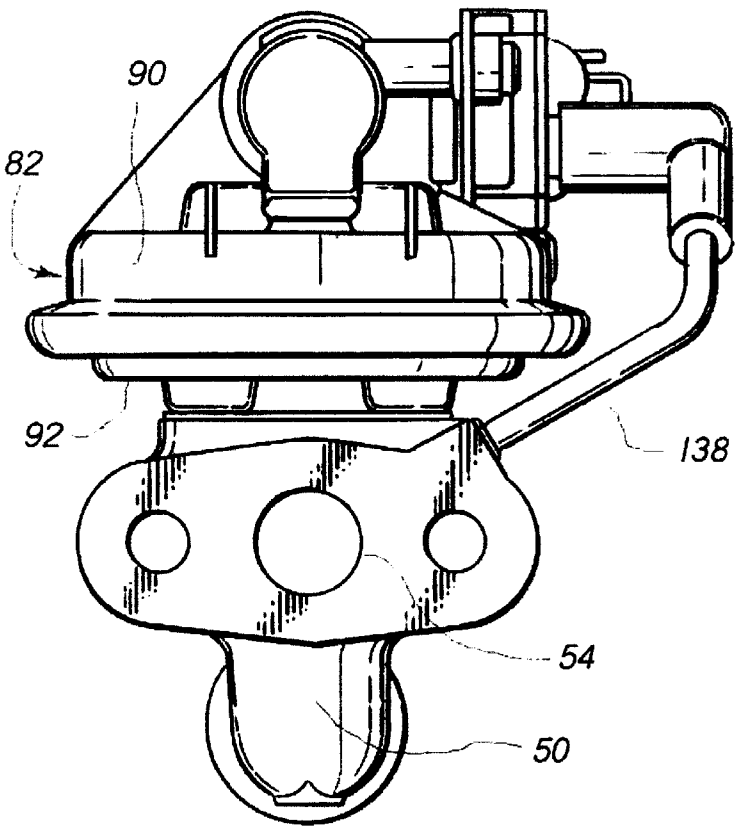
FIG. 2 is an end view of the exhaust gas recirculation system of the present invention.
Figure 6:
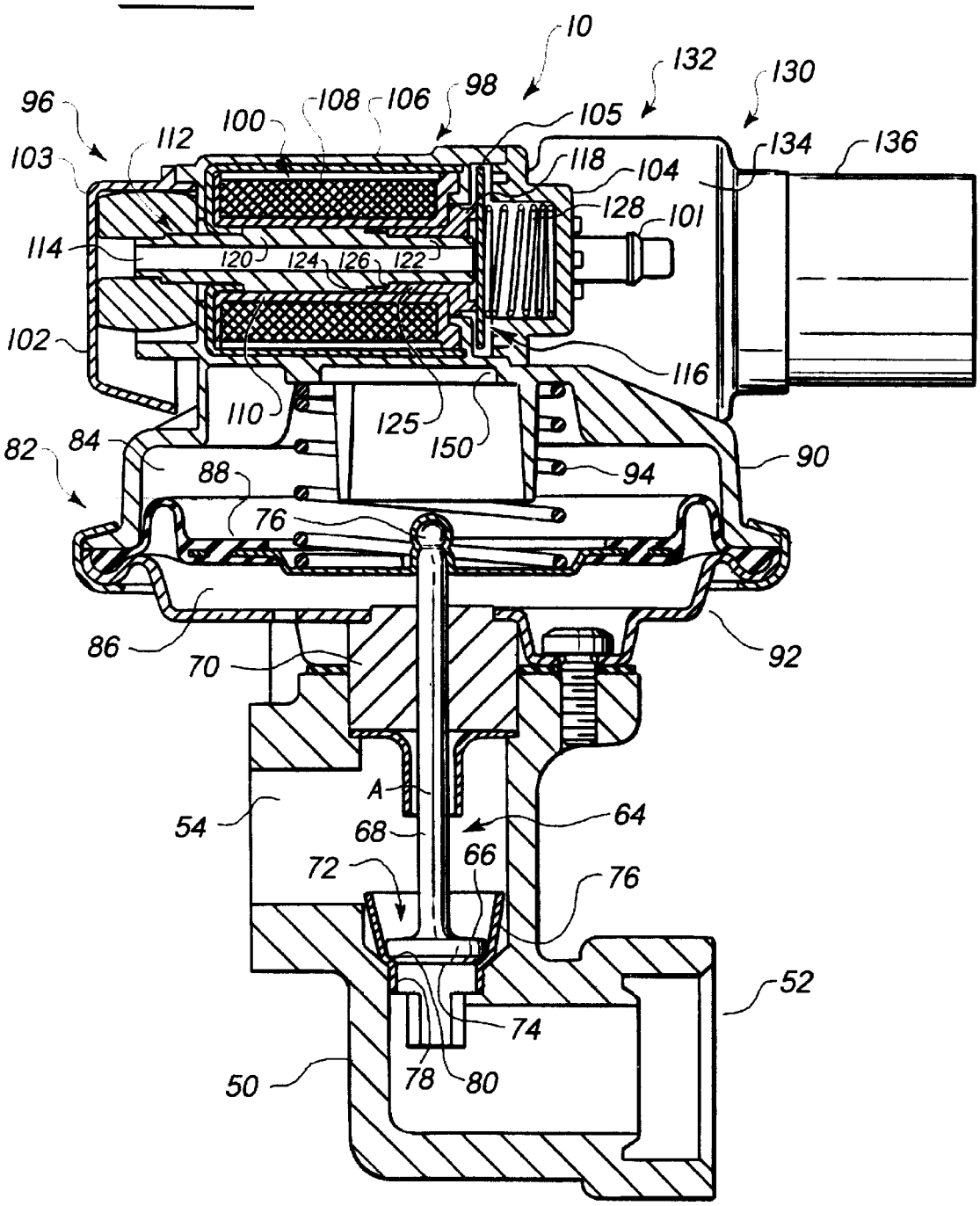
FIG. 6 is a cross-sectional side view of the exhaust gas recirculation system of the present invention.

Referring now to FIG. 1 in conjunction with FIGS. 2, 3 and 6 the exhaust gas recirculation system 10 is shown mounted at any convenient location on the engine 12 and is in fluid communication with both the intake manifold 32 and the exhaust manifold 46. To this end, the exhaust gas recirculation system 10 of the present invention includes a valve body, generally indicated at 50, having an exhaust port 52 which is adapted for fluid communication with a source of exhaust gas. In the embodiment illustrated in FIG. 1, this fluid communication is effected with the exhaust manifold 46 via one or more conduits represented by the dotted line 48. In addition, the valve body 50 is preferably a cast part and includes an intake port 54 which is adapted for fluid communication with the intake manifold 32 of the internal combustion engine 12. In the embodiment illustrated in FIG. 1, the exhaust gas recirculation system 10 is mounted directly to the intake manifold 32 and communicates therewith via a passage 56. However, those having ordinary skill in the art will appreciate from the description which follows that the exhaust gas recirculation system 10 may be mounted at any convenient place on the engine 12.

The exhaust gas recirculation system 10 also includes a valve member, generally indicated at 64. The valve member 64 is movable between open and closed positions to control the flow of exhaust gas from the exhaust port 52 to the intake port 54 of the system 10. More specifically, the valve member 64 includes a valve element 66 and a valve stem 68 extending from the valve element 66 and through a bushing 70 in the valve body 50. The valve element 66 is received on a valve seat, generally indicated at 72, formed in the valve body 50 at the exhaust port 52 when the valve member 64 is in its closed position. The valve seat 72 includes a generally frustoconically shaped insert which defines a first, generally larger diameter portion 76 and a second generally smaller diameter portion 78 with a transition portion 80 extending there between. On the other hand, the valve element 66 includes an annular shoulder 74 which is adapted to sealingly engage with the transition portion 80 of the valve seat 72 when the valve member 64 is in its closed position. The valve seat 72 and the valve element 66 act to induce turbulent flow of the exhaust gases as they move past the valve seat 72 when the valve member 64 is moved to its open position. Turbulent flow of the exhaust gases is conducive to better mixing between the recirculated exhaust gas and the fresh intake air received into the intake manifold 32.

Above the bushing 70, the valve stem 68 includes a nipple 76 formed at the distal end thereof to a purpose that will be discussed in greater detail below. More specifically, the valve stem 68 defines a longitudinal axis A of the valve member 64. The valve element 66 is movable from the closed position shown in FIG. 6 to the open position shown in FIG. 3 in a direction toward the valve seat 72 and parallel to the longitudinal axis A. Thus, in the embodiment disclosed herein, the exhaust gas recirculation system 10 employs a "pull to open" valve arrangement.

The exhaust gas recirculation system 10 further includes a diaphragm housing, generally indicated at 82, which is operatively mounted to the valve body 50 and supported thereby. The diaphragm housing 82 defines a vacuum cavity 84 in fluid communication with a source of negative pressure such as exists in the intake manifold 32 under certain engine operating conditions. The diaphragm housing 82 also defines an atmosphere cavity 86 which is in fluid communication with a source of second pressure. In the preferred embodiment, the source of second pressure is the ambient atmospheric pressure. A flexible diaphragm member 88 is disposed between the vacuum cavity 84 and the atmosphere cavity 86 and is operatively connected to the valve member 64. More specifically, the diaphragm member 88 is made of a steel reinforced neoprene or some other suitable flexible material. The valve member 64 is operatively connected to the diaphragm member 88 via a mechanical attachment at the nipple 76 located at the distal end of the valve stem 68. The diaphragm member 88 is movable in one direction in response to a negative pressure induced in the vacuum cavity 84 and in an opposite direction in response to a biasing force to move the valve member 64 between its open and closed positions as will be described in greater detail below.

The diaphragm housing 82 includes an upper housing member 90 and a lower housing member 92 with the diaphragm member 88 operatively supported therebetween so as to define the vacuum and atmosphere cavities, 84, 86 respectively. The lower housing member 92 is supported by the cast valve body 50. A biasing member 94 is supported within the diaphragm housing 82 and between the upper housing member 90 and the diaphragm member 88. The biasing member 94 serves to bias the valve member 64 toward its closed position. In the preferred embodiment illustrated in these figures, the biasing member is a coiled spring 94. However, those having ordinary skill in the art will appreciate that any number of biasing mechanisms commonly known in the related art may be employed for the same purpose.

The exhaust gas recirculation system 10 of the present invention also includes and integrated vacuum regulator, generally indicated at 96. The integrated vacuum regulator 96 is operable to control the movement of the valve member 64 between its opened and closed positions by controlling the negative pressure induced in the vacuum cavity 84. To this end, the vacuum regulator 96 includes a housing, generally indicated at 98, which is supported by the upper housing member 90 of the diaphragm housing 82. The vacuum regulator housing 98 supports a solenoid assembly, generally indicated at 100. The solenoid assembly 100 acts to control the negative pressure induced in the vacuum cavity 84 as will be described in greater detail below. As a function of its integration into the overall system, the vacuum regulator housing 98 is formed integrally with the upper housing member 90 of the diaphragm housing 82.

Figure 5:
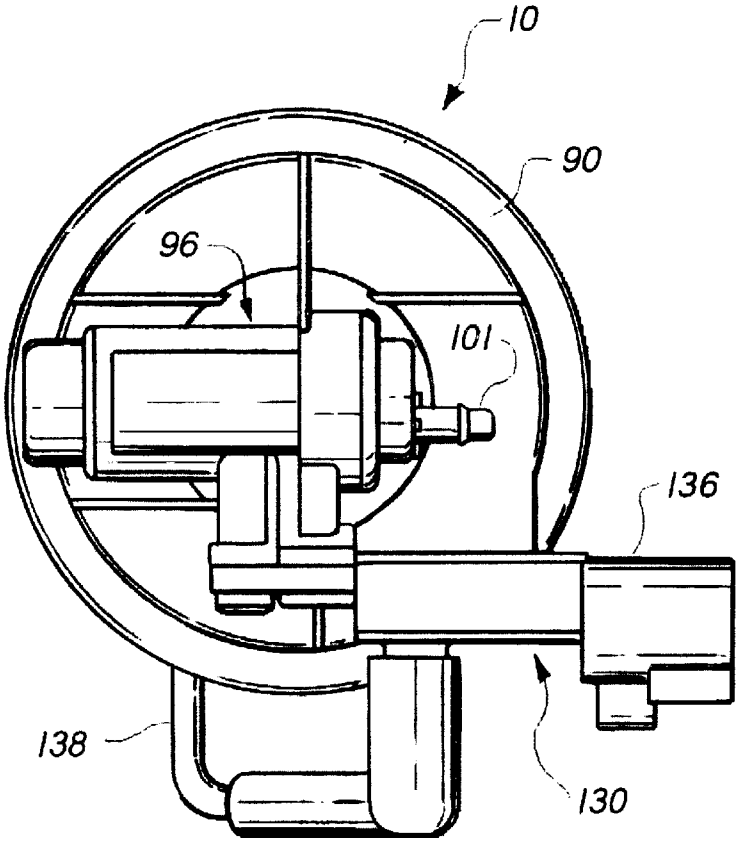
FIG. 5 is a top view of the exhaust gas recirculation system of the present invention.
Figure 4:
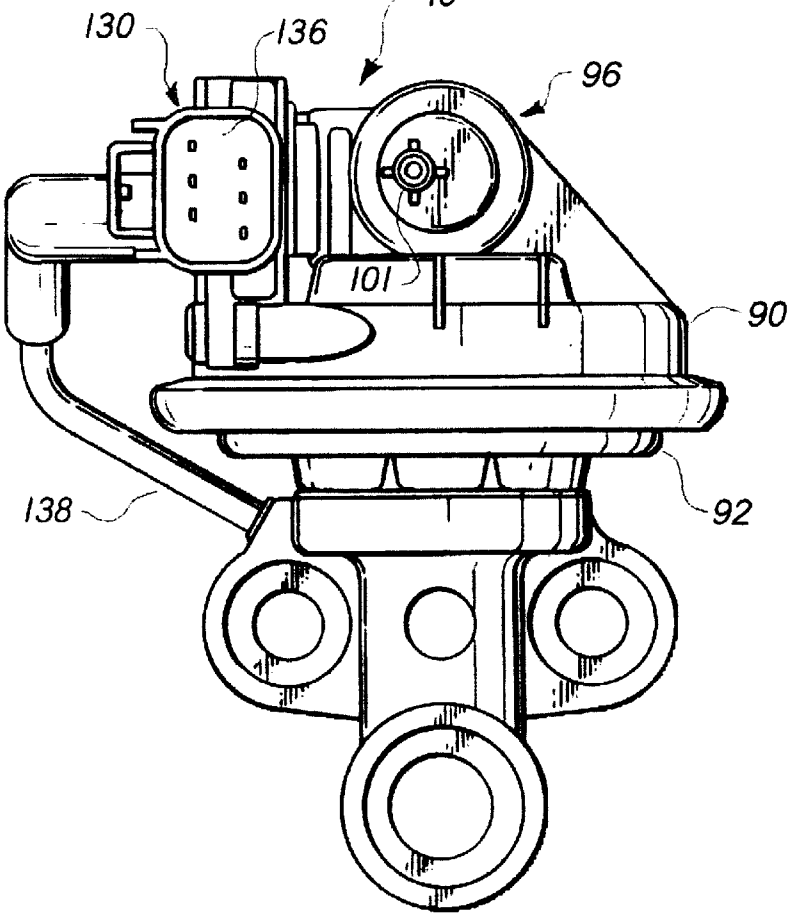
FIG. 4 is a front view of the exhaust gas recirculation system of the present invention.

The vacuum regulator housing 98 includes a pair of cup shaped end caps 102, 104 and a solenoid frame 106 extending therebetween, the vacuum regulator housing 98 being in fluid communication with vacuum cavity 84. The solenoid assembly 100 includes a solenoid coil 108 supported in the vacuum regulator housing 98 between the end caps 102, 104 and within the solenoid frame 106. A ferromagnetic valve member 105 is movably supported within the vacuum regulator housing 98 between open and closed positions in response to an electromagnetic force generated by the solenoid coil 108 thereby controlling the pressure in the vacuum cavity 84. The solenoid assembly 100 further includes a bobbin 110. The solenoid coil 108 includes a conductive wire, which is wrapped around the bobbin 110. The wire is connected to a source of electrical current. In addition, the solenoid assembly 100 includes a fixed, ferromagnetic pole piece, generally indicated at 112, having a passage 114 extending therethrough. The ferromagnetic solenoid valve member 105 is disposed in spaced relationship relative to the pole piece 112 even when the solenoid valve member 105 is in its closed position. More specifically, and to this end, the solenoid assembly 100 includes a sleeve, generally indicated at 116, which is located between the pole piece 112 and the coil bobbin 110. The sleeve 1 16 presents an annular valve seat 118. The solenoid valve member 105 is disposed in abutting relationship relative to the annular valve seat 118 when the valve member 105 is in its closed position. Furthermore, the annular valve seat 118 serves to space the solenoid valve member 105 from the pole piece 112. As shown in FIGS. 4 through 6, the end cap 102 includes the diaphragm housing inlet nipple 101, which provides fluid communication to a source of negative pressure.

The pole piece 112 includes a body 120 and a stepped portion 122 having a smaller diameter cross-sectional area than the body 120. The sleeve 116 presents a first, larger diameter portion 124 and a second, smaller diameter portion 125 with a shoulder 126 defined therebetween. The stepped portion 122 of the body 120 of the pole piece 112 is received in cooperating relationship with the shoulder 126 of the sleeve 116 thereby mechanically fixing the pole piece 112 relative to the sleeve 116.

The solenoid assembly 100 also includes a biasing member 128 which biases the solenoid valve member 105 into engagement with the valve seat 118 when it is in its closed position. In the preferred embodiment illustrated in these figures, the biasing member 128 is a coiled spring supported between one of the cup shaped end caps 104 of the vacuum regulator housing 98 and the solenoid valve member 105. However, those having ordinary skill in the art will appreciate that any number of biasing mechanisms may be used to accomplish this purpose.

The upper housing member 90 of the diaphragm housing 82 defines a flow diverter 150 which provides a tortuous path for fluid communication between the vacuum cavity 84 and the atmosphere through the solenoid valve member 105 thereby minimizing condensation in the exhaust gas recirculation system 10 as will be described in greater detail below.

The exhaust gas recirculation system 10 of the present invention further includes an integrated pressure sensor, generally indicated at 130. The pressure sensor 130 senses the difference between the pressure in the vacuum cavity 84 and the pressure in the intake port 54. To this end, the pressure sensor 130 includes a housing 132 which is formed integrally with the upper housing member 90 of the diaphragm housing 82, housing 132 being in fluid communication with vacuum cavity 84. A sensor 134 is operatively supported within the housing 132. The pressure sensor 130 also includes an electrical terminal 136 for communicating with a source of electrical power as well as an engine control module (ECM) (not shown). In the preferred embodiment, the electrical terminal 136 is formed integrally with the housing 132 of the pressure sensor 130. Furthermore, the electrical terminal 136 provides electrical power to both the sensor of the pressure sensor 130 as well as the solenoid assembly 100 of the vacuum regulator 96. A conduit 138

(FIGS. 1–5) provides fluid communication between the pressure sensor 134 and the intake port 54.

In operation, the exhaust gas recirculation system 10 opens the flow between the exhaust manifold 46 and the intake manifold 32 when the negative pressure in the vacuum cavity 84 causes the diaphragm member 88 to move upwardly as viewed in FIG. 6 against the biasing force of the coiled spring 94. The pressure sensor 130 monitors the pressure in the vacuum cavity 84 relative to the pressure in the intake manifold 32. Based on signals received from the ECM (not shown), the vacuum regulator 96 energizes the coil 108 which moves the valve member 105 to its opened position against the biasing force of the spring 128. This vents the vacuum cavity 84 to atmosphere thereby equalizing the pressure in the vacuum and atmosphere cavities 84, 86, respectively. In this operative mode, the diaphragm member 88 and, thus, the valve member 64 are moved downwardly thereby closing the valve. When the vacuum cavity 84 is vented, air flowing from this cavity must pass through the flow diverter 150. As noted above, the flow diverter 150 defines a tortuous path and minimizes the condensation in the system.

Thus, based on certain predetermined parameters such as engine load, throttle positions, acceleration, etc. the vacuum regulator 96 is energized on command by an engine control module (ECM). Actuation of the vacuum regulator 96 causes immediate and direct actuation of the valve member 64 via the coiled spring 94 acting on the diaphragm member 88 to its closed position. The differential pressure between the vacuum cavity 84 and the intake manifold 32 is at all times monitored by the pressure sensor 130 which feeds this information back to the ECM.

The exhaust gas recirculation system 10 of the present invention, provides accurate, incremental control of the movement of the valve member 64 with a much faster response time when compared with EGR systems known in the related art. Furthermore, the exhaust gas recirculation system 10 enjoys very precise valve positioning capabilities which are highly repeatable. The system 10 results in an elimination of a number of separate components which are remotely mounted in conventional EGR systems such as the vacuum regulator, the pressure sensor as well as the associated on-board plumbing typically employed in connection with EGR systems known in the related art. Thus, the exhaust gas recirculation system 10 of the present invention is smaller and more compact than conventional EGR systems known in the related art. This results in improved "packaging" characteristics which allow engine designers greater freedom when positioning the exhaust gas recirculation system of the present invention relative to other related components.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. An exhaust gas recirculation system for an internal combustion engine, said system comprising:

a valve body having an exhaust port adapted for fluid communication with a source of exhaust gas, an intake port adapted for fluid communication with the intake manifold of an internal combustion engine, and a valve member movably supported within said body between open and closed positions thereby controlling the flow of exhaust gas from said exhaust port to said intake port;

a diaphragm housing operatively mounted to said valve body and supported thereby, said diaphragm housing defining a vacuum cavity in fluid communication with a source of negative pressure, an atmosphere cavity in fluid communication with a source of second pressure and a diaphragm member disposed therebetween and operatively connected to said valve member, said diaphragm member movable in one direction in response to a negative pressure induced in said vacuum cavity and in an opposite direction in response to a biasing force to move said valve member between said open and closed positions;

an integrated vacuum regulator having a vacuum regulator housing operatively mounted to said diaphragm housing, said vacuum regulator operable to control the movement of said valve member between said open and closed positions by controlling the negative pressure induced in said vacuum cavity, said vacuum regulator housing supporting a solenoid assembly which acts to control the negative pressure induced in said vacuum cavity; said solenoid assembly includes a solenoid coil supported in said vacuum regulator housing and a valve member which is movable between open and closed positions in response to an electromagnetic force generated by said solenoid coil to control the pressure in said vacuum cavity;

a flow diverter within said diaphragm housing providing a tortious path for fluid communication between said vacuum cavity and the atmosphere through said solenoid valve member; and an integrated pressure sensor for sensing the difference between the pressure in said vacuum cavity and the pressure at said intake port.

2. An exhaust gas recirculation system as set forth in claim 1 wherein said valve member has a valve element and a valve stem extending from said valve element, said valve element being movable from said closed position to said open position in a direction parallel to said longitudinal axis.

3. An exhaust gas recirculation system as set forth in claim 2 further including a biasing member acting on said valve member to bias said valve element in a direction toward said closed position.

4. An exhaust gas recirculation system as set forth in claim 3 wherein said biasing member is a coiled spring acting on said valve member in the direction of said closed position.

5. An exhaust gas recirculation system as set forth in claim 1 wherein said diaphragm housing includes an upper housing member and a lower housing member with said diaphragm member operatively supported therebetween to define said vacuum and atmosphere cavities, said upper housing member of said diaphragm housing serving to support said vacuum regulator.

6. An exhaust gas recirculation system as set forth in claim 5 wherein said biasing member is supported within said diaphragm housing and between said upper housing member and said diaphragm member so as to thereby bias said valve member toward its closed position.

7. An exhaust gas recirculation system as set forth in claim 5 wherein said vacuum regulator housing is formed integrally with said upper housing member of said diaphragm housing.

8. An exhaust gas recirculation system as set forth in claim 7 wherein said solenoid assembly includes a bobbin, said solenoid coil including a conductive wire wrapped around said bobbin, said wire connected to a source of electrical current.

9. An exhaust gas recirculation system as set forth in claim 7 wherein said vacuum regulator housing includes a pair of end caps and a solenoid frame extending there between and about said coil.

10. An exhaust gas recirculation system as set forth in claim 7 wherein said solenoid assembly includes a fixed, ferromagnetic pole piece having a passage extending therethrough, said solenoid valve member disposed in spaced relationship relative to said pole piece when said solenoid valve member is in said closed position.

11. An exhaust gas recirculation system as set forth in claim 10 wherein said solenoid assembly includes a sleeve disposed between said pole piece and said coil bobbin, said sleeve presenting an annular valve seat; said solenoid valve member disposed in abutting relationship relative to said annular valve seat when said valve member is in said closed position.

12. An exhaust gas recirculation system as set forth in claim 11 wherein said pole piece includes a body and a stepped portion having a smaller diameter cross-sectional area than said body, said sleeve presenting a first, larger diameter portion and a second, smaller diameter portion with a shoulder defined therebetween, said stepped portion of said body of said pole piece being received in cooperating relationship with said shoulder of said sleeve thereby mechanically fixing said pole piece relative to said sleeve.

13. An exhaust gas recirculation system as set forth in claim 11 wherein said solenoid assembly includes a biasing member which biases said solenoid valve member into engagement with said valve seat and its closed position.

14. An exhaust gas recirculation system as set forth in claim 13 wherein said biasing member is a coiled spring supported between said cup shaped end cap of said vacuum regulator housing and said solenoid valve member.

15. An exhaust gas recirculation system as set forth in claim 5 wherein said pressure sensor includes a housing formed integrally with said upper housing member of said diaphragm housing and including a sensor and an electrical terminal for communicating with a source of electrical power.

16. An exhaust gas recirculation system as set forth in claim 15 wherein said electrical terminal provides electrical power to both of said sensor of said pressure sensor and said solenoid assembly of said vacuum regulator.

17. An exhaust gas recirculation system as set forth in claim 15 wherein said pressure sensor includes a conduit for providing fluid communication between said sensor and said intake port when said valve member is in its open position.

* * * * *